US006723005B2

(12) United States Patent
Hueber

(10) Patent No.: US 6,723,005 B2
(45) **Date of Patent: *Apr. 20, 2004**

(54) GOLF CLUBS

(76) Inventor: David B. Hueber, 123 Nandina Cir., Ponte Vedra Beach, FL (US) 32082

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 246 days.

(21) Appl. No.: 09/388,663

(22) Filed: Sep. 2, 1999

(65) Prior Publication Data

US 2002/0016214 A1 Feb. 7, 2002

(51) Int. Cl.[7] ..... A63B 53/00
(52) U.S. Cl. ..... 473/291
(58) Field of Search ..... 473/291, 290, 473/287–289

(56) References Cited

U.S. PATENT DOCUMENTS 3,655,188 A * 4/1972 Solheim
4,762,322 A * 8/1988 Molitor et al.
5,228,688 A * 7/1993 Davis
5,356,138 A * 10/1994 Chen et al.
5,421,098 A * 6/1995 Muldoon
5,421,577 A * 6/1995 Kobayashi
5,429,353 A * 7/1995 Hoeflich
5,480,145 A * 1/1996 Sherwood
5,547,426 A * 8/1996 Wood ..... 473/290
5,643,108 A * 7/1997 Cheng ..... 473/329
5,779,559 A * 7/1998 Eberle
5,813,919 A * 9/1998 Best ..... 473/290
5,879,241 A * 3/1999 Cook ..... 473/289
5,885,170 A * 3/1999 Takeda ..... 473/306
5,890,971 A * 4/1999 Shiraishi ..... 473/291
6,183,376 B1 * 2/2001 Peters et al.

* cited by examiner

*Primary Examiner*—Stephen Blau
(74) *Attorney, Agent, or Firm*—Thomas C. Smitts

(57) ABSTRACT

A golf club equivalent in driving distance to a standard 2-iron, 3-iron, 4-iron, 5-iron or 6-iron, where each club varies from the equivalent standard iron club in that the shaft is shorter, the loft angle is decreased, the lie angle is increased, and the club head weight is increased, where the swing weight remains approximately the same and where the club head is a metal club head of the type used for drivers and fairway woods.

13 Claims, 2 Drawing Sheets

GOLF CLUBS

BACKGROUND OF THE INVENTION

This invention relates generally to the field of golf clubs and more particularly to the field of golf clubs having relatively large club heads of the type referred to as metal woods.

As is well known in the industry, golf clubs are specifically constructed to perform certain tasks, with a set of clubs being divisible into three main groups or types—the clubs known as woods or, more commonly now, metal woods, the clubs known as irons, and a putter. The metal woods are long-shafted, low-lie (lie being the angle of the shaft relative to the ground when the club head is grounded) clubs with large club heads which are relatively heavy and full bodied, typically having a large striking surface backed by a generally rounded body mass. Metal woods are designed to drive the ball the longest distances, the ball being hit from the tee box where the ball is placed onto a tee for striking or from a good lie in the fairway or rough. The metal woods are typically designated as a driver or a numbered wood of either number 1 or 3, although it is known to also produce wood numbers of 5, 7 and even 9. The lower the number, the farther the ball is designed to travel after being struck, with higher number woods producing more lofted and therefore shorter shots. The irons are clubs used for middle and short distance shots, including shots from the tee box for short holes or holes where control is important and shots from the fairway, the rough, waste, sand or grass bunkers. The irons have medium and short shaft lengths relative to the woods, striking surfaces with greater loft so as to hit a higher shot with less roll upon impact, and the club heads are generally blade shaped with higher lie angles. The irons are usually numbered 2 through 9, plus higher lofted and thus shorter hitting irons designated as pitching wedges and sand wedges. The lower the number, the farther the golf ball should travel when struck, with the higher numbered irons and the wedges producing shots with extremely high trajectories and minimal roll. Often the 4-iron and lower are designated as long irons, the 5-iron through the 7-iron are designated as middle irons, and the 8-iron through the wedges are designated as short irons. The final type of golf club is the putter, used on the greens to roll rather than lift the ball. With the irons and woods, the general rule is that long shafts are combined with less lofted club faces in order to promote distance, the long shaft providing greater club head velocity and the low loft (i.e., a striking face closer to perpendicular to the ground) causing a more level ball flight path with maximum roll. For the shorter distance irons, the shafts are kept short to improve control and swing consistency, since maximum club head velocity is not required for the shot, and the loft of the striking face is very high so as to lift the ball and minimize roll after landing.

Playing consistently good golf remains foremost a matter of skill, even with the vast amount of technological advances made relative to golf club design, material of construction, instruction and practice techniques, etc., since the inception of the sport. Designing clubs which maximize distance is important, but designing clubs which maximize control and accuracy is probably of greater overall importance. For most golfers, hitting the irons designated as the 2-iron, 3-iron, 4-iron, 5-iron and 6-iron pose the most problems in terms of control and consistency, because the shafts are still relatively long in comparison to the higher-control, short-shafted short irons, while the club head weight and body style is lighter and much less forgiving of error than the club head weight and body style of the metal woods. In addition, golf courses are designed such that shots of a distance calling for the 2-iron through 7-iron must often be hit from the rough, waste, sand or grass bunkers when the initial drive from the tee is not accurately played. Because the golf ball may lie in high grass, the club which is designed to provide the correct distance may have a club face with too low of a loft, a shaft too long to allow for a steep angle of attack on the ball, and a club head too light to pass through the rough or sand to extricate the ball, requiring the golfer to use a higher lofted short iron to remove the ball from a bad lie. Because the shorter iron is required in these situations, the ball cannot be driven the desired distance and extra strokes will be required to complete the hole since the golfer is forced to play a shorter shot.

Certain other situations encountered on the golf course demand shots of a type which the standard clubs are not designed to provide. For example, when hitting into a stiff wind or when hitting a shot beneath low tree limbs, the golfer wants to hit a shot with low arc or trajectory. In order to avoid lifting the ball, a longer club with less loft is chosen and the golfer chokes down on the grip to shorten the effective length of the shaft and moves the ball back in his stance. With the ball back in the stance, the swing will be more vertical, imparting more backspin to ball and undesirably causing it to take a higher trajectory. Choking down on the shaft alters the performance characteristic of the club, lowering the swing weight of the club and reducing shaft flex. The lie of the club is now flatter, causing the toe of the club to dig into the ground and push the shot to the right. Another non-standard golf shot is the use of a 3-wood or 5-wood to chip a ball onto a green from the fringe or apron. Here the fairway wood is used like a putter, with the added mass and weight of the club head minimizing friction and resistance from the fringe prior to contact and with the increased loft relative to a putter lifting the ball out of the fringe to travel in the air a short distance before beginning to roll. However, in this instance the shaft of the club is very long, often about 8 inches longer than the putter shaft, and the lie of the club is much too flat relative to the more upright angle of the shaft when the club is used as a putter to provide for a proper lie angle when hitting this shot. If the golfer extends the club head outward to correspond to the proper lie angle designed into the club, the shot is very difficult to properly align.

It is an object of this invention to provide a golf club or set of clubs equivalent to the standard 2-iron 3-iron, 4-iron, 5-iron and 6-iron with regard to the distance of travel of a golf ball when struck by the particular club, which incorporates desirable characteristics of a metal wood club head into a short shafted club, such that the shorter shaft length provides for increased control and consistency, the greater club head mass and weight provide for easier penetration of the club head through rough or sand, and the combination of all elements provides a set of clubs with the same swing weight as the equivalent standard irons. It is a further object to provide such a club or set of clubs where the club head is constructed as a metal wood head, but with increased weight over club heads found in drivers or fairway woods, where the swing weight is equivalent to the swing weight of the corresponding iron, and where the length of the shaft and lie of the club are equivalent to that of a middle or short iron, which results in a club with a shaft length approximately one inch shorter and a lie approximately 2 to 5 degrees greater than the equivalent iron. It is a further object to provide a golf club which is the equivalent in striking distance to irons but with a metal wood club head, where the metal wood head increases accuracy, because with the center of gravity of the club head moved back from the striking face, the club head has greater resistance to twisting for shots hit off-center, and further because the inherent curvilinear face of the metal wood club head compensates and corrects when the ball is struck off-line and off-center.

SUMMARY OF THE INVENTION

Figure 1:
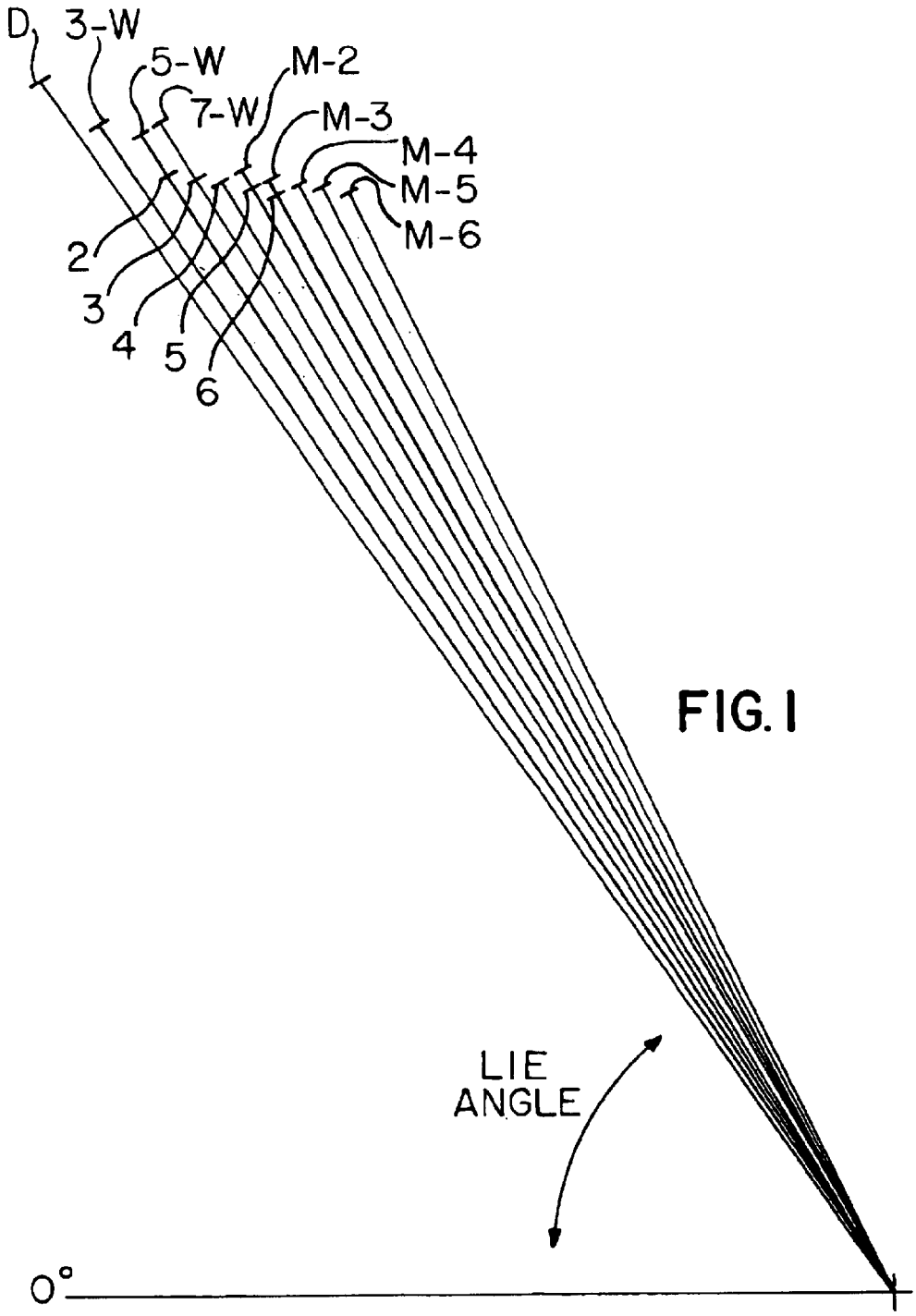
FIG. 1 is a diagram showing the shaft lengths and lie angles of the clubs of the invention in relation to the shaft lengths and lie angles of standard woods and irons.

The invention comprises individual golf clubs or a set of golf clubs, designated herein as M-2, M-3, M-4, M-5 and M-6 clubs, which are equivalent to a standard 2-iron, 3-iron, 4-iron, 5-iron and 6-iron, respectively, with regard to the distance of travel of a golf ball struck with a particular club, such that a golfer who normally strikes a golf ball for example 160 yards with a standard 6-iron will hit the golf ball the same distance with the equivalent M-6 club of the invention, and one who normally strikes a golf ball for example 190 yards with a standard 3-iron will hit the golf ball the same distance with the M-3 club. Each club of the invention varies from the equivalent standard iron club in that the shaft is shorter, the loft angle is decreased, the lie angle is increased, and the club head weight is increased, where the swing weight remains approximately the same and where the club head is a metal club head of the type used for drivers and fairway woods.

The M-2 club, equivalent to the standard 2-iron, will have a shaft of approximately 38.5 inches, a club head weight of approximately 259 to 279 grams, a loft of approximately 17 degrees and a lie of approximately 60 degrees. The M-3 club, equivalent to the standard 3-iron, will have a shaft of approximately 38 inches, a club head weight of approximately 265 to 285 grams, a loft of approximately 20 degrees and a lie of approximately 61 degrees. The M-4 club equivalent to a standard 4-iron will have a shaft approximately 37.5 inches, a club head weight of approximately 271 to 291 grams, a loft of approximately 23 degrees and a lie of approximately 62 degrees. The M-5 club equivalent to a standard 5-iron will have a shaft approximately 37 inches, a club head weight of approximately 277 to 297 grams, a loft of approximately 26 degrees and a lie of approximately 63 degrees. The M-6 club equivalent to a standard 6-iron will have a shaft approximately 36.5 inches, a club head weight of approximately 283 to 303 grams, a loft of approximately 29 degrees and a lie of approximately 64 degrees to produce a golf shot equivalent to a 6-iron.

The improved golf clubs of the invention can also be compared to standard fairway woods in that the shaft is significantly shorter, typically by approximately 3.5 to 4 inches, the lie is increased to account for the shortened shaft, and the club head weight is significantly greater, typically approximately 48 to 50 grams heavier.

DETAILED DESCRIPTION OF THE INVENTION

The invention will now be described in detail with regard for the best mode and the preferred embodiment.

A golf club comprises a shaft connected to a club head, the club head being used to strike the golf ball. A club head may be structured in a generally blade-like manner, where the breadth of the club head behind the striking surface is relatively short compared to its distance from toe to heel. Such clubs are referred to as irons. A second type of club head is structured with a relatively large, somewhat ovoid shaped, hollow body, where the breadth of the club head behind the striking surface is relatively equal to its toe to heel distance, and these clubs are referred to as woods. The vast majority of woods are now made of metal because of the superior properties of that material.

The woods have longer shafts, flatter lie angles to accommodate the long shafts and less loft in order to drive the golf ball in a lower trajectory and therefore a longer distance with greater roll. Irons have shorter shafts, greater lie angles and more loft to drive the ball in a higher trajectory and therefore a shorter distance with less roll. The lie angle is defined as the angle of the shaft relative to the ground when the club head is grounded, i.e., when the club head is positioned horizontally. The loft angle is defined as the angle of the club head striking face relative to vertical when the club head is grounded and the shaft is positioned in a vertical plane. Absolute standards for the dimensions of clubs designated a particular iron or wood do not exist, but a large majority of clubs are constructed as shown in Table 1, and these dimensions are defined herein to be taken as standard dimensions for the designated standard clubs.

TABLE 1

| CLUB | SHAFT LENGTH | LIE | LOFT |
|---|---|---|---|
| Driver (1-Wood) | 44 in. | 55 deg. | 10 deg. |
| 3-Wood | 42 | 56 | 15 |
| 4-Wood | 41.5 | 56.5 | 18 |
| 5-Wood | 41 | 57 | 21 |
| 7-Wood | 41 | 58 | 24 |
| 1-Iron | 40 | 56 | 15 |
| 2-Iron | 39.5 | 57 | 18 |
| 3-Iron | 39 | 58 | 22 |
| 4-Iron | 38.5 | 59 | 26 |
| 5-Iron | 38 | 60 | 30 |
| 6-Iron | 37.5 | 61 | 34 |
| 7-Iron | 37 | 62 | 38 |
| 8-Iron | 36.5 | 63 | 42 |
| 9-Iron | 36 | 64 | 46 |

TABLE 1-continued

| CLUB | SHAFT LENGTH | LIE | LOFT |
|---|---|---|---|
| Pitching Wedge | 35.5 | 65 | 50 |
| Sand Wedge | 35.5 | 65 | 56 |

Of the above standard dimensions, the shaft length will be most variable when fitting clubs to individual golfers, since this dimension is directly related a golfer's height. Shaft length may vary by one to two inches.

Likewise, there are no absolute club head weights for designated clubs, but the following weights for the listed clubs are weights which will yield a swing weight in the D2 to D4 range for a large majority of such clubs, and are to be taken herein as standard club head weights. The difference between the club head weights for graphite shafts versus steel shafts is to account for the difference in weight of the two materials.

TABLE 2

| CLUB | CLUB HEAD WEIGHT (Graphite) | CLUB HEAD WEIGHT (Steel) |
|---|---|---|
| 3-Wood | 227 grams | 217 grams |
| 4-Wood | 233 | 223 |
| 5-Wood | 239 | 229 |
| 7-Wood | 239 | 229 |

The improved clubs have the following dimensions and characteristics, which are also summarized below in Table 3. Each club of the invention varies from the equivalent standard iron club in that the shaft is shorter, the loft angle is decreased, the lie angle is increased, and the club head mass and weight is increased, where the swing weight remains approximately the same and where the club head is a metal club head of the type used for drivers and fairway woods. For the improved golf club which is designated herein as the M-2 club, which will strike the ball a distance equivalent to a standard 2-iron, the shaft is preferably approximately 38.5 inches in length, club head weight is preferably approximately 259 to 279 grams, the loft is preferably approximately 17 degrees and the lie is preferably approximately 60 degrees. The club head is of the wood-type, in that it is a relatively large, generally ovoid-shaped, hollow metal body having a relatively large dimension in the direction perpendicular to the striking face of the club head. The M-2 club will have the same approximate swing weight of the standard 2-iron. The club head weight is greater than standard wood-type club heads by approximately 40 to 50 grams, and the range of preferred club head weight is a function of the variation in weight between graphite and steel shafts, with slightly lower club head weight being utilized with the slightly heavier steel shafts, and slightly higher club head weight being utilized with the slightly lighter graphite shafts.

For the improved golf club which is designated herein as the M-3 club, which will strike the ball a distance equivalent to a standard 3-iron, the shaft is preferably approximately 38 inches in length, club head weight is preferably approximately 265 to 285 grams, the loft is preferably approximately 20 degrees and the lie is preferably approximately 61 degrees. The club head is of the wood-type. The M-3 club will have the same approximate swing weight of the standard 3-iron.

For the improved golf club which is designated herein as the M-4 club, which will strike the ball a distance equivalent to a standard 4-iron, the shaft is preferably approximately 37.5 inches in length, club head weight is preferably approximately 271 to 291 grams, the loft is preferably approximately 23 degrees and the lie is preferably approximately 62 degrees. The club head is of the wood-type. The M-4 club will have the same approximate swing weight of the standard 4-iron.

For the improved golf club which is designated herein as the M-5 club, which will strike the ball a distance equivalent to a standard 5-iron, the shaft is preferably approximately 37 inches in length, club head weight is preferably approximately 277 to 297 grams, the loft is preferably approximately 26 degrees and the lie is preferably approximately 63 degrees. The club head is of the wood-type. The M-5 club will have the same approximate swing weight of the standard 5-iron.

For the improved golf club which is designated herein as the M-6 club, which will strike the ball a distance equivalent to a standard 6-iron, the shaft is preferably approximately 36.5 inches in length, club head weight is preferably approximately 283 to 303 grams, the loft is preferably approximately 29 degrees and the lie is preferably approximately 64 degrees. The club head is of the wood-type. The M-6 club will have the same approximate swing weight of the standard 6-iron.

Figure 2:
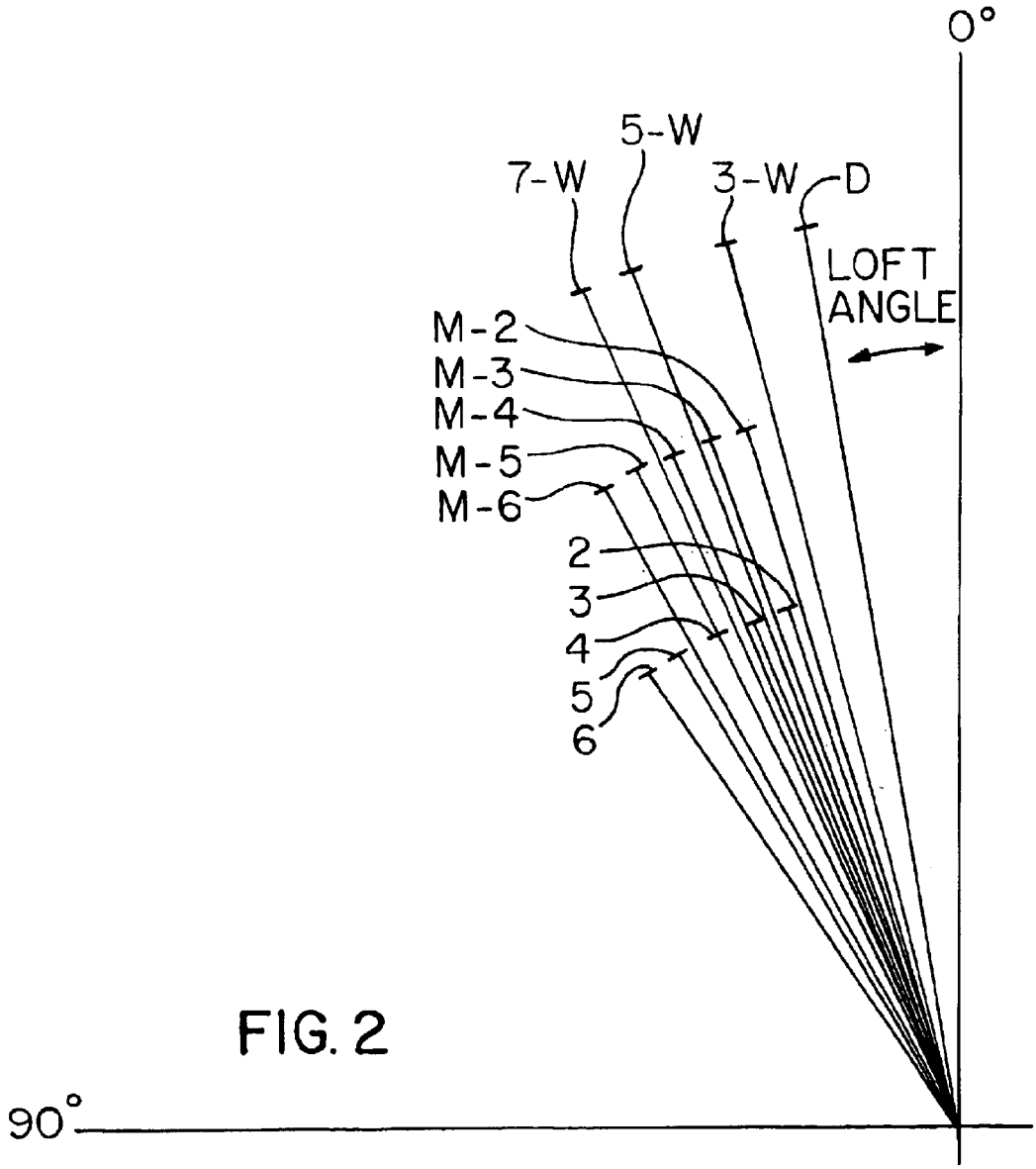
FIG. 2 is a diagram showing the loft angles of the clubs of the invention in relation to the loft angles of standard woods and irons.

With reference to FIG. 1, the shaft length and lie angle of clubs of the invention designated as M-2, M-3, M-4, M-5 and M-6 are compared to those same characteristics of standard irons numbered 3, 4, 5 and 6 and standard woods designated D (for driver), 3-W, 5-W and 7-W. In FIG. 2, the loft angles are compared.

TABLE 3

| CLUB | SHAFT LENGTH | LIE | LOFT | CLUB HEAD WEIGHT |
|---|---|---|---|---|
| M-2 | 38.5 in. | 60 deg. | 17 deg. | 279-259 g. |
| M-3 | 38 | 61 | 20 | 285–265 |
| M-4 | 37.5 | 62 | 23 | 291–271 |
| M-5 | 37 | 63 | 26 | 297–277 |
| M-6 | 36.5 | 64 | 29 | 303–283 |

An alternative mode of describing the golf clubs of the invention is to express them in terms of equivalent characteristics, such that a club designated as M-2 for driving a ball the distance equivalent to a standard 2-iron will have a shaft length approximately equal to the shaft length of a 4 iron and a lie approximately equal to the lie of a 5-iron. A club designated as M-3 for driving a ball the distance equivalent to a standard 3-iron will have a shaft length approximately equal to the shaft length of a 5 iron and a lie approximately equal to the lie of a 6-iron. A club designated as M-4 for driving the ball a distance equivalent to a standard 4-iron will have a shaft length approximately equal to the shaft length of a 6-iron and a lie approximately equal to the lie of a 7-iron. A club designated as M-5 for driving the ball a distance equivalent to a standard 5-iron will have a shaft length approximately equal to the shaft length of a 7-iron and a lie approximately equal to the lie of a 8-iron. A club designated as M-6 for driving the ball a distance equivalent to a standard 6-iron will have a shaft length approximately equal to the shaft length of a 8-iron and a lie approximately equal to the lie of a 9-iron. As described previously, the loft angles are preferably less than the loft angles for the equivalent irons by from approximately 1 to 5 degrees, while the club head weight and mass will be significantly greater, with a wood-type metal club head.

The clubs as so constructed provide more control and accuracy to the golfer on all shots, and especially in difficult lies where high grass or sand presents difficulty in striking the ball cleanly. The shorter shaft length and steeper lie angle allow the golfer to strike the ball with a more downward and direct swing arc than with a standard length fairway wood, long or middle iron. The greater club head mass and weight more easily cuts through the grass or sand impediment with less likelihood of the club head being twisted or pulled off angle by contact with the grass or sand. Since the swing weight is equivalent to the standard iron, the golf shot will feel the same to the golfer, and no alteration in the normal swing is required to hit the shot correctly. Even in a fairway lie, the club design improves accuracy since the ball will travel the standard equivalent distance even with the reduced length shaft because of the increased club head weight. The shorter shaft length and the large striking surface of the heavy wood-type club head are features which will increase accuracy of all golfers, but especially of average or below-average golfers, since maintaining the proper swing path is easier with a shorter shaft and there is a larger sweet spot for accurate shots on the striking face of a wood-type club head than with a standard iron. Modern metal wood club heads are constructed with the center of gravity lowered and recessed back from the striking face, and the striking face itself is bulged and rolled in order to impart corrective action to shots which are not struck by the optimum striking point of the club face. Thus providing a club with a wood-type club head which the golfer can use for shots traditionally played with irons will dramatically improve accuracy.

It is understood that equivalents and substitutions to certain elements set forth above may be obvious to those skilled in the art, and therefore the true scope and definition of the invention is to be as set forth in the following claims.

I claim:

1. A set of five correlated golf club metal woods for the performance of golf shots of the type and distance associated with the set of irons designated as a 2-iron, 3-iron, 4-iron, 5-iron and 6-iron, where a first club of said set of golf club metals wood has a shaft approximately 38.5 inches in length, a club head weight of approximately 259 to 279 grams, a loft of approximately 17 degrees and a lie of approximately 60 degrees to produce a golf shot equivalent to a 2-iron, a second club of said set of golf club metals wood has a shaft approximately 38 inches in length, a club head weight of approximately 265 to 285 grams, a loft of approximately 20 degrees and a lie of approximately 61 degrees to produce a golf shot equivalent to a 3-iron, a third club of said set of golf club metal woods has a shaft approximately 37.5 inches in length, a club head weight of approximately 271 to 291 grams, a loft of approximately 23 degrees and a lie of approximately 62 degrees to produce a golf shot equivalent to a 4-iron, a fourth club of said set of golf club metal woods has a shaft approximately 37 inches in length, a club head weight of approximately 277 to 297 grams, a loft of approximately 26 degrees and a lie of approximately 63 degrees to produce a golf shot equivalent to a 5-iron, and a fifth club of said set of golf club metal woods has a shaft approximately 36.5 inches in length, a club head weight of approximately 283 to 303 grams, a loft of approximately 29 degrees and a lie of approximately 64 degrees to produce a golf shot equivalent to a 6-iron.

2. A set of at least two correlated golf club metal woods, said set comprising a first metal wood having a shaft approximately 38.5 inches in length, a club head weight of approximately 259 to 279 grams, a loft of approximately 17 degrees and a lie of approximately 60 degrees, and a second metal wood having a shaft approximately 38 inches in length, a club head weight of approximately 265 to 285 grams, a loft of approximately 20 degrees and a lie of approximately 61 degrees.

3. The set of correlated golf club metal woods in claim 2, further comprising a third metal wood having a shaft approximately 37.5 inches in length, a club head weight of approximately 271 to 291 grams, a loft of approximately 23 degrees and a lie of approximately 62 degrees.

4. The set of correlated golf club metal woods in claim 3, further comprising a fourth metal wood having a shaft approximately 37 inches in length, a club head weight of approximately 277 to 297 grams, a loft of approximately 26 degrees and a lie of approximately 63 degrees.

5. The set of correlated golf club metal woods in claim 4, further comprising a fifth metal wood having a shaft approximately 36.5 inches in length, a club head weight of approximately 283 to 303 grams, a loft of approximately 29 degrees and a lie of approximately 64 degrees.

6. A set of at least three correlated golf club metal woods, said set comprising a first metal wood having a shaft approximately 38.5 inches in length, a club head weight range of approximately 259 to 279 grams, a loft of approximately 17 degrees and a lie of approximately 60 degrees, and at least two successive metal woods each having different shaft lengths, different club head weight ranges, different lofts and different lies from each other and each having a shorter shaft length, an increased lie, an increased loft and an increased range of club head weight from said first metal wood, wherein each of said at least two successive metal woods produces a golf shot of shorter distance and greater loft than said first metal wood, and wherein any one of said metal woods comprising said set differs from another one of said metal woods by approximately 0.5 inches in shaft length, approximately one degree in lie, approximately 3 degrees in loft, and approximately 6 grams in club head weight range.

7. The set of correlated golf club metal woods in claim 6, further comprising a third successive metal wood having a different shaft length, different club head weight range, different loft and different lie from said first metal wood and said two successive metal woods, said third successive metal wood having a shorter shaft length, an increased lie, an increased loft and an increased range of club head weight from said first metal wood and from said two successive metal woods, wherein said third successive metal wood produces a golf shot of shorter distance and greater loft than said first metal wood and said two successive metal woods, and wherein any one of said metal woods comprising said set differs from another one of said metal woods by approximately 0.5 inches in shaft length, approximately one degree in lie, approximately 3 degrees in loft, and approximately 6 grams in club head weight range.

8. The set of correlated golf club metal woods in claim 7, further comprising a fourth successive metal wood having a different shaft length, different club head weight range, different loft and different lie from said first metal wood, said two successive metal woods and said third successive metal wood, said fourth successive metal wood having a shorter shaft length, an increased lie, an increased loft and an increased range of club head weight from said first metal wood, said two successive metal woods and said third successive metal wood, wherein said fourth successive metal wood produces a golf shot of shorter distance and greater loft than said first metal wood, said two successive metal woods and said third successive metal wood, and wherein any one of said metal woods comprising said set differs from another one of said metal woods by approximately 0.5 inches in shaft length, approximately one degree in lie, approximately 3 degrees in loft, and approximately 6 grams in club head weight range.

9. A golf club metal wood having a shaft approximately 38.5 inches in length, a club head weight of approximately 259 to 279 grams, a loft of approximately 17 degrees and a lie of approximately 60 degrees.

10. A golf club metal wood having a shaft approximately 38 inches in length, a club head weight of approximately 265 to 285 grams, a loft of approximately 20 degrees and a lie of approximately 61 degrees.

11. A golf club metal wood having a shaft approximately 37.5 inches in length, a club head weight of approximately 271 to 291 grams, a loft of approximately 23 degrees and a lie of approximately 62 degrees.

12. A golf club metal wood having a shaft approximately 37 inches in length, a club head weight of approximately 277 to 297 grams, a loft of approximately 26 degrees and a lie of approximately 63 degrees.

13. A golf club metal wood having a shaft approximately 36.5 inches in length, a club head weight of approximately 283 to 303 grams, a loft of approximately 29 degrees and a lie of approximately 64 degrees.

* * * * *